US005118367A

United States Patent [19]

Starinshak

[11] Patent Number: 5,118,367

[45] Date of Patent: Jun. 2, 1992

[54] PROCESS FOR TREATING A BRASS-PLATED STEEL WIRE

[75] Inventor: Thomas W. Starinshak, Wadsworth, Ohio

[73] Assignee: The Goodyear Tire & Rubber Company, Akron, Ohio

[21] Appl. No.: 411,990

[22] Filed: Sep. 25, 1989

[51] Int. Cl.[5] ..... C23C 22/12

[52] U.S. Cl. ..... 148/262; 148/269

[58] Field of Search ..... 148/262

[56] References Cited

U.S. PATENT DOCUMENTS

| | | | |
|---|---|---|---|
| 2,272,216 | 2/1942 | Lodeesen | 148/262 |
| 2,774,701 | 12/1956 | Koryta et al. | 154/130 |
| 3,957,543 | 5/1976 | Shinomiya | 148/250 |
| 3,961,993 | 6/1976 | Palisin | 148/255 |
| 3,996,074 | 12/1976 | Rakestraw | 148/255 |
| 4,182,639 | 1/1980 | Pignocco | 148/260 |
| 4,883,722 | 11/1989 | Coppens et al. | 428/625 |

FOREIGN PATENT DOCUMENTS 0169047 7/1985 European Pat. Off. .

*Primary Examiner*—Sam Silverberg

*Attorney, Agent, or Firm*—Bruce J. Hendricks

[57] ABSTRACT

The present invention relates to a process for treating a brass-plated steel wire comprising applying to the wire an aqueous zinc phosphate solution having a pH of from about 2 to about 3 and containing (1) a total of from about 28 to 32 grams per liter of phosphoric acid, (2) from about 8 to 11 grams per liter of free phosphoric acid, (3) from about 8 to 11 grams per liter of $Zn^{+2}$ which may be derived from the group consisting of zinc oxide, zinc phosphate or mixtures thereof, and (4) wherein the mole ratio of total phosphoric acid to free phosphoric acid ranges from 2.5:1 to 4.0:1. In accordance with the present invention, the zinc phosphate coating on the brass-plated steel cord inhibits corrosion and adhesion of the wire to rubber after vulcanization is improved.

6 Claims, No Drawings

PROCESS FOR TREATING A BRASS-PLATED STEEL WIRE

BACKGROUND OF THE INVENTION

Vehicle tires, particularly pneumatic or semi-pneumatic tires, are often reinforced by means of cords consisting of twisted or cabled brass-coated steel filaments. The twisted or cabled filaments consist of a series of individual wires. The wires are frequently high-carbon steel coated with a thin layer of alpha brass. After the steel wire has been electroplated with the brass coating, it is cold drawn to form a filament and subsequently stranded and/or cabled to form the cord.

Tire cord made from brass-plated steel wire requires special care during factory processing to minimize surface contamination. Plated steel wires are generally subject to corrosion of the steel substrate and oxidation of the brass coating, particularly if improperly handled or stored prior to incorporation into a rubber composite which is ultimately shaped to a molded article such as pneumatic tire. Corrosion and oxidation can also be caused from other external agents or elements in an environment where the cord is a reinforcement such as in a rubber composite. Such corrosion and oxidation can result in poor adhesion between the cords and rubber which, in turn, can result in a failure of the reinforcement in the rubber composite or can cause degradation of a good adhesive bond during service life of the composite. Clean, untreated brass-coated steel wire will normally have sufficient good initial adhesion to the adjacent rubber. However, the adhesion usually will drop with time, i.e., with aging due to heat, stress and/or chemical degradation or corrosion effects. Various additives described in the literature have in certain instances shown improved initial and aged adhesion. Unfortunately; such additives have often not proved entirely satisfactory either due to required complexities in their preparation or the mixed results realized from their use. Organic corrosion inhibitors are usually applied to the finished cabling by immersion into a water or other organic solvent containing the inhibitor or by vapor treatment. These procedures require additional equipment and processing time. Therefore, there exists a need for a method of treating brass-plated steel wire which protects the bare metallic surface from corrosion and concomitantly improves the initial and aged adhesion of the wire to the rubber environment within the vulcanized composite.

SUMMARY OF THE INVENTION

The present invention relates to a process for treating a brass-plated steel wire comprising applying to the brass-plated steel wire an aqueous zinc phosphate solution having a pH of from about about 2 to about 3 and containing (1) a total of from about 23 to 32 grams per liter of phosphoric acid, (2) from about 8 to 11 grams per liter of free phosphoric acid, (3) from about 8 to 12 grams per liter of $Zn^{+2}$ which may be derived from the group consisting of zinc oxide, zinc phosphate or mixtures thereof, and (4) wherein the mole ratio of total phosphoric acid to free phosphoric acid ranges from to 2.5:1 to 4.0:1.

DETAILED DESCRIPTION OF THE INVENTION

In accordance with a preferred embodiment, the present invention relates to a process for treating a brass-plated steel wire comprising applying to the brass-plated steel wire an aqueous zinc phosphate solution having a pH of from about 2 to about 3 and containing (1) a total of from about 28 to about 32 grams per liter of phosphoric acid, (2) from about 8 to about 11 grams per liter of free phosphoric acid, (3) from about 8 to about 12 grams per liter of $Zn^{+2}$ derived from the group consisting of zinc oxide, zinc phosphate or mixtures thereof, and (4) wherein the mole ratio of total phosphoric acid to free phosphoric acid ranges from 2.5:1 to 4.0:1. The phrase "free phosphoric acid" includes the phosphoric acid which is available to react with the surface of the wire to initiate the reaction with the zinc phosphate solution. The phrase "free phosphoric acid" excludes that acid which has complexed with $Zn^{+2}$ in solution. The amount of free phosphoric acid can be determined by a simple acid-base titration with 0.5N sodium hydroxide and bromethylmol blue. The amount of total acid can be determined by acid-base titration with 1N sodium hydroxide with phenolphthalein. It should also be noted that the concentration of the primary ingredients (zinc and phosphoric acid) may vary. The zinc phosphate solution may be diluted or more concentrated with good results.

The aqueous zinc phosphate solution contains components which form the zinc phosphate in situ. Aside from the phosphoric acid, the aqueous solution contains a zinc compound capable of providing the $Zn^{+2}$ cation in the aqueous environment having a pH of from about 2 to about 3. The amount of $Zn^{+2}$ that is present in the aqueous solution may range from about 8 to about 12 grams per liter of the $Zn^{+2}$. These weight ranges are based on the $Zn^{+2}$ cation and not the total weight of the zinc compound from which the $Zn^{+2}$ may be derived. Examples of zinc compounds which may be used in the present invention include zinc oxide, zinc phosphate or mixtures thereof.

The brass surface of the wire is coated with zinc phosphate in accordance with the present invention. The application of the solution may be accomplished by immersing the wire in a bath of an aqueous zinc phosphate solution which contains phosphoric acid and a zinc compound which forms a complex with the acid when in solution. The solution may also be applied by wipes, pads, spraying etc. Preferably the wire is immersed in a bath. The pH of the solution should range from about 2.0 to about 3.0 . The immersion time of the brass-coated steel wire may vary depending on the amount of coating one desires to apply. Generally, the time of immersion ranges from about 2 to about 40 seconds. Preferably the time of immersion is from about 2 to about 10 seconds.

The wires that are treated in accordance with the present invention are brass plated high carbon steel. The term "high carbon steel" is intended to include carbon steel, also called ordinary steel, straight carbon steel or plain carbon steel such as American Iron and Steel Institute Grade 1070 or 1080 high carbon steel. This steel owes its properties chiefly to the presence of carbon without substantial amounts of other alloying elements. In this respect see Metals Handbook, The American Society for Metals, Metals Park, Cleveland, OH.

The brass coating on the steel wire contains alpha brass as the major component. Alpha brass is known to contain from about 62 to 75% copper and 38 to 25% zinc, respectively. It is believed that zinc phosphate in the solution interacts with the zinc on the surface in the brass coating (in the form of zinc oxide) to form a complex. This complex serves as a protective barrier of any environmental degradation of the underlying brass.

The amount of zinc phosphate solution which is applied to the brass-plated steel wire may vary. Optimum thickness and amounts are a function of variables such as the nature of the brass surface, viz., mode of deposition, thickness of initial oxide layers, zinc content, brass thickness, as well as the reactivity of the rubber-vulcanization system. The phosphate coating weights may range from about 20 to about 150 milligrams per kilogram of wire. Preferably, the weight of the phosphate coating ranges from about 25 to about 50 milligrams per kilogram of wire.

In addition to the phosphoric acid and zinc compound, the aqueous zinc phosphate solution may also contain conventional additives known to those skilled in the art to improve the coating morphology or coating speed. Some examples of additives include chlorates, nickel salts, nitrates and nitrites. If one uses any of the conventional additives, one must insure that a sufficient amount of free phosphoric acid to initiate the reaction is present and maintain the total phosphoric acid and zinc concentrations within the ranges.

The temperature of the aqueous zinc phosphate solution may vary and range from about a temperature of from about ambient to about 60° C. Preferably, the temperature ranges from about 25° to about 35° C.

Following the application of the zinc phosphate solution, the wire may be contacted with wipes. Use of wipes assist in controlling the amount of residual solution remaining and the phosphate coating weight.

After the aqueous zinc phosphate has been applied to the wire, the treated wire may be rinsed in an aqueous solution to remove any excess zinc phosphate solution. The treated wire may be rinsed by immersion in a bath or by a water spray. In one embodiment, the rinse solution may also contain dilute phosphoric acid. In most instances, an exposure time to the rinse solution of from about 1 to about 5 seconds has been found to be sufficient. In some instances, a rinse is not necessary if, for example, an efficient solution wipe is used and adequate drying is utilized.

As known to those skilled in the art, the rinsed wire may be contacted with a wipe to avoid excessive rinse solution from being conveyed with the wire.

After the treated wire has been rinsed, the wire is dried by methods known to those skilled in the art. Examples of such methods include wipes and pressurized hot air. The temperature of the hot air may vary from near ambient to above 400° C. The wire should be sufficiently dried prior to take-up of the treated wire. Preferably the hot air dryer is at a temperature from about 100° to 300° C. depending on the residence time in the dryer. Typical times are 3 to 10 seconds.

Upon winding, the treated brass-plated wire may be fine drawn in a manner known to those skilled in the art and converted to a filament or cord for use in a rubber vulcanizate composite.

The wire may be utilized in combination with a rubber to form a rubber vulcanizate composite. The rubber surrounding the metal can be any rubber, preferably rubbery materials having available unsaturation such as natural and synthetic vulcanizable rubbers and rubbery polymers of dienes preferably of open chain conjugated dienes having 4 to 8 carbon atoms. Specific examples of rubbery materials which may be utilized in combination with the treated cords are natural rubber, polybutadiene-1,3, polyisoprene, poly-2,3-dimethyl-butadiene-1,3, poly-2-chlorobutadiene-1,3 and the like. Other synthetic rubbers include those obtained from 1,3-dienes by copolymerization with each other or with at least one copolymerizable monomer such as isobutylene, styrene, acrylonitrile, methacrylate, ethacrylate, methyl methacrylate, 4-vinyl pyridine and the like. The polymeric diene rubbers generally contain at least 50% by weight of the diene and preferably contain from about 55–85% by weight of the diene. However, copolymers, terpolymers and the other multi-component polymers containing as little as 35% or less by weight of diene may also be employed. Additional rubbery materials that may be used in combination with the treated cord are unsaturated and polymers containing acid groups obtained by the copolymerization of a major amount of a conjugated diene with an olefinically unsaturated carboxylic acid. Still other rubbers include those formed by the copolymerization of dienes with alkyl acrylates and by the polymerization of an alkyl acrylate with at least one other unsaturated monomer followed by hydrolysis. Rubbery polyester urethanes, polyether urethanes and polyester amide urethanes having curable double bonds or available unsaturation and rubber reclaimed from the foregoing may also be used. Mixtures of two or more of the foregoing rubbers may be employed as ingredients in the vulcanizates formed with the treated wire. The preferred rubbers are the natural and synthetic polyisoprenes, the polybutadienes, the polychloroprenes, the copolymers of isobutylene with isoprene, copolymers of butadiene-1,3 with styrene, and copolymers of butadiene-1,3 with acrylonitrile.

The present invention is further illustrated by the reference to the following examples which are intended to be representative and not restrictive of the scope of the present invention. Unless otherwise indicated, all parts and percentages are by weight.

Brass-plated (63.5±2.5% copper, 36.5±2.5% zinc, coating weight=3.8±0.3 gram brass per kg steel wire) steel (AISI grade 1070 or 1080) cable having a 4×0.25 construction was used in all of the examples.

EXAMPLE 1

Rubber compounds, identified herein as compounds A and B, were prepared for the purpose of comparing brass-coated steel wire which had been treated in accordance with the present invention versus untreated wire. The rubber compounds were mixed by conventional techniques according to the following recipes shown in Table I.

TABLE I

| Compound | Parts by Weight A | Parts by Weight B |
|---|---|---|
| Polyisoprene | 100 | 100 |
| Zinc Oxide | 8 | 8 |
| Fatty Acid | 2 | 2 |
| Amine Antioxidant | 1 | 1.8 |
| Sulfenamide-type Accelerator | 1.2 | .75 |
| Sulfur | 2.4 | 4 |
| Cobalt Compound | 3 | 1 |
| Carbon Black | 60 | 55 |
| Particulate Fillers | — | 65 |
| Processing Oils | 4.6 | 10 |

The treated brass-plated wire was immersed in an aqueous phosphate solution having a pH of 2.3 and containing 29.8 grams/liter of total phosphoric acid, 9.4 grams/liter of zinc oxide and 10 grams/liter of free phosphoric acid. The wire was immersed in the aqueous phosphate solution for a total of 34 seconds, air wiped and passed through a 100° C. drier with hot air flow for about 5 seconds.

The data from the physical testing of the untreated and treated wire is listed in Tables II and III.

The rubber adhesion test involves embedding wire between two layers of compounded rubber, curing the rubber, and then measuring the force required to pull out the wire from the rubber.

Table II belows lists the data from the testing of zinc phosphate treated and untreated wire (control) for compounds A and B of Table I.

Adhesion tests were applied to composites of the untreated and treated wires with rubber (1) after a 35 minute cure at 311° F. (original), (2) after immersing the cured composite for 96 hours in salt water at 194° F. (salt), (3) after a 10-day aging of uncured green block at 90 percent humidity and 98° F. (humidity), and (4) after 6 hours steam aging at 248° F. of the cured composite (steam). The original values are measured in newtons and normalized so the to untreated values are 100.

TABLE II

| | Rubber Adhesion | |
|---|---|---|
| | Compound A | Compound B |
| Original | | |
| Untreated | 100 | 100 |
| Treated | 116 | 109 |
| Salt | | |
| Untreated | 79 | 72 |
| Treated | 90 | 95 |
| Humidity | | |
| Untreated | 97 | 79 |
| Treated | 115 | 84 |
| Steam | | |
| Untreated | 92 | 42 |
| Treated | 93 | 49 |

The untreated samples produce satisfactory values for standard brass coatings but when the phosphate is applied, there is a significant improvement in both original and aged test values. The primary adhesion test is the salt water and humidity which indicate that the phosphate coating is improving the corrosion protection from salt and water. Also, this coating does not reduce the original adhesion values.

The untreated and treated wires were compared in compounds A & B for their corrosion. The "cathodic polarization" was measured by applying a DC current to a sustained loaded wire in a one normal sulfuric acid solution and measuring the time to failure due to absorption of hydrogen. The cathodic polarization is a very good indicator of corrosion protection of the substrate. The values for cathodic polarization are measured in seconds and normalized so the untreated values are 100.

The test method for testing the "cut corrosion" assists in determining loss of adhesion strength due to corrosion degradation. The test conditions for determining cut corrosion consists of (1) samples cured for 25 minutes at 149° C., (2) wait 24 hours before aging test, (3) wire between rubber is coated with protective paint, (4) 3.5% NaCl solution at ambient temperature with air bubbling: 12×0.20+1 (means 12 filaments each being 0.20 mm in diameter plus a spiral wrap)—0, 2 days: 2×0.30—0, 2, 4 days: 4×0.25—0, 2, 4 days, (5) rubber cut between samples before Instron testing to measure reduction in pull out force after soaking.

The testing for "corrosion fatigue" assists in determining the reduction in fatigue life as a result of corrosion degradation utilizing 3-roll fatigue equipment. The test conditions are (1) tire cord cured in rubber, (2) samples length=75 mm, (3) exposed to 3% NaCl solution at 50° C. with wire ends sealed with papafilm to protect from solution and vapors: 12×0.20+1—0, 2 days; 2×0.30—0, 2, 4 days: 4×0.25—0, 2, 4 days, (4) preload=10% of breaking load, (5) diameter of working pulley is 0.6 inches for 12×0.20 and 0.75 inches for other constructions.

TABLE III

| Corrosion Tests | |
|---|---|
| Cathodic polarization | |
| Untreated | 100 |
| Treated | 299 |
| | Compound B |
| Cut corrosion (% retained) | |
| Untreated | 53 |
| Treated | 70 |
| Corrosion fatigue (% retained) | |
| Untreated | 58 |
| Treated | 68 |

The cut corrosion value of the treated sample reflects a 17% improvement in retained adhesion, while the corrosion fatigue is improved by 10% using the phosphate coating.

EXAMPLE 2

The treated brass-plate wires were prepared in accordance with Example 1 except the wires were immersed in the phosphate solution for a total of 13 seconds followed by an air wipe, ambient drying for about 15 seconds, then hot air dried at 50° C. No rinse was used. The wires were tested in the same manner as in Example 1.

TABLE IV

| | Rubber Adhesion | |
|---|---|---|
| | Compound A | Compound B |
| Original | | |
| Untreated | 100 | 100 |
| Treated | 109 | 110 |
| Salt | | |
| Untreated | 67 | 67 |
| Treated | 85 | 90 |
| Humidity | | |
| Untreated | 79 | 63 |
| Treated | 91 | 68 |
| Steam | | |
| Untreated | 79 | 48 |
| Treated | 81 | 55 |

Once again, there is a significant improvement in original aged adhesion values by using the phosphate coating.

TABLE V

| Corrosion Tests | |
|---|---|
| Cathodic polarization | |
| Untreated | 100 |
| Treated | 185 |
| | Compound B |
| Cut corrosion (% retained) | |
| Untreated | 60 |
| Treated | 87 |
| Corrosion fatigue (% retained) | |
| Untreated | 51 |

TABLE V-continued

| Corrosion Tests | |
|---|---|
| Treated | 76 |

Improvements are also apparent at reduced immersion times.

EXAMPLE 3

The treated brass-plated wire was immersed in the aqueous phosphate solution of Example 1. The wire was immersed in the phosphate solution for a total of 4 seconds, rinsed in water for about a second and passed through a hot air drier at 75° C. for 5 seconds. The treated and untreated wires were tested in the same manner as in Example 1.

TABLE VI

| | Rubber Adhesion | |
|---|---|---|
| | Compound A | Compound B |
| Original | | |
| Untreated | 100 | 100 |
| Treated | 98 | 95 |
| Salt | | |
| Untreated | 43 | 44 |
| Treated | 50 | 79 |
| Humidity | | |
| Untreated | 74 | 89 |
| Treated | 78 | 91 |
| Steam | | |
| Untreated | 64 | 63 |
| Treated | 64 | 72 |

The treated samples have equal to or better values for the rubber adhesion tests. As can seen below, the corrosion tests also reflect benefits at the very low immersion times with a short water rinse.

TABLE VII

| Corrosion Tests | |
|---|---|
| Cathodic polarization | |
| Untreated | 100 |
| Treated | 212 |
| | Compound B |
| Cut corrosion (% retained) | |
| Untreated | 37 |
| Treated | 48 |
| Corrosion fatigue (% retained) | |
| Untreated | 36 |
| Treated | 70 |

EXAMPLES 4-6

For the purposes of comparison, Examples 4-6 were conducted in order to demonstrate the importance of immersion in a zinc phosphate solution and following the immersion with an aqueous rinse. Example 4 was the control with no treatment. Example 5 was immersed in a phosphate bath for 5 seconds, wiped, air dried for 70 seconds and hot air dried at 120° C. for 16 seconds. Example 6 was immersed in a phosphate bath for 5 seconds, wiped, rinsed in water and hot air dried at 120° C. for 16 seconds. The wires were tested in the same manner as in Example 1. In addition to Compounds A or B, the control and treated wires were tested in Compound C listed below in Table VIII. The wires were tested in the same manner as in Example 1.

TABLE VIII

| Compound (MA233) | Parts by Weight C |
|---|---|
| Polyisoprene | 100 |
| Zinc Oxide | 8 |
| Fatty Acid | 2 |

TABLE VIII-continued

| Compound (MA233) | Parts by Weight C |
|---|---|
| Amine Antioxidant | 0.7 |
| Sulfenamide-type Accelerator | 1 |
| Sulfur | 4 |
| Cobalt Compound | 3 |
| Carbon Black | 60 |
| Processing Oil | 6 |

TABLE IX

| | Rubber Adhesion | | |
|---|---|---|---|
| | Compound A | Compound B | Compound C |
| Original | | | |
| Untreated | 100 | 100 | 100 |
| Treated | 125 | 101 | 112 |
| Treated and Rinsed | 107 | 128 | 133 |
| Salt | | | |
| Untreated | 78 | 69 | 70 |
| Treated | 125 | 109 | 104 |
| Treated and Rinsed | 107 | 94 | 94 |
| Humidity | | | |
| Untreated | 102 | 91 | 87 |
| Treated | 126 | 99 | 102 |
| Treated and Rinsed | 111 | 106 | 92 |
| Steam | | | |
| Untreated | 101 | 71 | 91 |
| Treated | 134 | 93 | 103 |
| Treated and Rinsed | 102 | 91 | 136 |

It can be seen that the treated samples out perform the untreated control cable in all tests and compounds.

TABLE X

| | Cut Corrosion Data for Compound B | | | | |
|---|---|---|---|---|---|
| | Original | % | Aged | % | % Retained |
| Untreated | 306 | 100 | 175 | 100 | 57 |
| Treated | 350 | 114 | 281 | 161 | 80 |
| Treated and Rinsed | 351 | 115 | 143 | 82 | 41 |

| Cathodic Polarization for Compound B | |
|---|---|
| Untreated | 100 |
| Treated | 109 |
| Treated and Rinsed | 105 |

The above data indicate that the treated sample without a rinse has better corrosion performance than the rinsed sample.

What is claimed is:

1. A process for treating a brass-plated steel wire comprising applying to a brass-plated steel wire an aqueous zinc phosphate solution having a pH of from about 2 to about 3 containing (1) from about 28 to 32 grams per liter of total phosphoric acid, (2) from about 8 to 11 grams per liter of free phosphoric acid, (3) from about 8 to 12 grams per liter of $Zn^{+2}$ which may be derived from the group consisting of zinc oxide, zinc phosphate or mixtures thereof, and (4) wherein the mole ratio of total phosphoric acid to free phosphoric acid ranges from 2.5:1 to 4.0:1.

2. The process of claim 1 wherein the $Zn^{+2}$ is derived from zinc oxide.

3. The process of claim 1 wherein the wire is rinsed with an aqueous solution after the zinc phosphate solution has been applied to the wire.

4. The process of claim 1 wherein the brass-plated wire is dried following the application of the zinc phosphate solution.

5. The process of claim 1 wherein the aqueous zinc phosphate solution is applied to provide a coating of zinc phosphate ranging from a thickness of from about 20 to about 150 mg/kg of wire.

6. The process of claim 1 wherein the aqueous zinc phosphate solution is applied by immersing the wire into a bath for about 2 to about 40 seconds.

* * * * *